United States Patent [19]

Bolwig

[11] Patent Number: 4,516,192

[45] Date of Patent: May 7, 1985

[54] LAMP CARRIAGE ARM FOR SAFETY HATS

[75] Inventor: Rolf W. Bolwig, Sudbury, Canada

[73] Assignee: Rotabo Industries Inc., Cooper Cliff, Canada

[21] Appl. No.: 569,849

[22] Filed: Jan. 11, 1984

[51] Int. Cl.[3] ..... F21L 15/14

[52] U.S. Cl. ..... 362/107; 362/190; 362/191; 362/427; 362/431; 362/432

[58] Field of Search ..... 362/107, 190, 191, 427, 362/431, 432

[56] References Cited

U.S. PATENT DOCUMENTS 2,531,585 11/1950 Pope ..... 362/105 X 4,265,561 5/1981 Heckele ..... 362/105 X

*Primary Examiner*—Stephen J. Lechert, Jr.

*Attorney, Agent, or Firm*—R. Craig Armstrong

[57] ABSTRACT

A lamp carriage arm, adapted for attachment to a safety hat, is disclosed. The lamp carriage arm offers improved lighting for miners and other workers by virtue of the lamp being positioned roughly in the area of above and in front of the safety hat wearer's collarbone. The lamp carriage arm attaches at one end to one side of the safety hat, and extends downwardly in spaced relationship to the side of the safety hat wearer's head. Conventional lighting, e.g. a miner's lamp, is carried at the other end of the lamp carriage arm. Preferably, the attachment of the lamp to the carriage arm is pivotal, so that the direction of the lamp beam may be varied. Thus the use of a ball and socket joint is disclosed, although other means may be employed. Adjustment means for varying the position of the lamp are also disclosed.

21 Claims, 6 Drawing Figures

LAMP CARRIAGE ARM FOR SAFETY HATS

BACKGROUND OF THE INVENTION

1. Field of the Invention

This invention relates generally to safety equipment, and specifically to a carriage arm adapted for attachment to a safety hat to support a miner's lamp or the like.

2. Description of the Prior Art

In the prior art, it is well known to attach lamps to safety hats or helmets, particularly in the mining industry. In the case of miners' lamps, the traditional location of the miner's lamp is on the front of the miner's helmet. This is shown in numerous previous patents, such as for example Canadian Pat. Nos. 80,858, 113,677, and 1,101,755, and U.S. Pat. No. 4,199,802, which are cited for general interest rather than for specific relevance to the present invention.

The problems with the traditional location for the lamp are numerous. In mining, the traditional location provides fairly good illumination for a rock face of from ten to thirty feet away from the miner. However, for close-up work such as that performed by mechanics, electricians, engineers, etc., the traditional location is less than satisfactory, since the cone of the illumination tends to overshoot the focus of the worker's attention. As a result, the worker frequently resorts to removing the lamp from the hat, and holding it in one hand to illuminate the work location. Frustration and inefficiency are inevitable results, particularly if the work requires the use of both hands. Minor injuries due to inadequate lighting in such situations are extremely common, and in fact are presently considered to be almost an inevitable part of underground work.

In addition to the problems of the traditional lamp location in illuminating close-up work, there is an even more serious problem in illuminating the ground in front of a miner when he or she is walking in the mine. Slip and fall injuries in mines are numerous, and it is well documented that inadequate lighting is a factor in many such accidents. The miner must either walk with the ground not directly illuminated, or must walk with his or her head pointed downwardly, or must remove the light from the helmet and point it by hand. None of these is a satisfactory solution.

One solution which has been attempted is to increase the candlepower of the lamps. This does not attack the root of the problem, however, and the increased candlepower also produces increased glare. Glare is a problem at the best of times.

It is an object of the present invention to provide a lamp carriage arm for attachment of a lamp to a safety hat to avoid some of the problems associated with the prior art.

It is a further object of the invention to provide improved safety hat mounted lighting for miners and others.

SUMMARY OF THE INVENTION

In accordance with the present invention there is provided a lamp carriage arm, adapted for attachment at one end to one side of a safety hat to extend downwardly in spaced relationship to the side of the safety hat wearer's head. The lamp carriage arm comprises an arm portion, first attachment means at one end of the arm portion for attaching the arm portion to the safety hat, and second attachment means remote from the first attachment means for attaching a lamp for carriage roughly in the area of above and in front of the safety hat wearer's collarbone.

In accordance with another aspect of the invention, there is provided lighting apparatus adapted for attachment to a safety hat, comprising a lamp carriage arm, attachment means at one end of the lamp carriage arm for attachment to one side of the safety hat, and a lamp attached to the other end of the lamp carriage arm, the carriage arm extending downwardly when attached to the safety hat, in spaced relationship to the safety hat wearer's head, such that the lamp is positioned roughly in the area of above and in front of the wearer's collarbone.

In accordance with yet another aspect of the invention, there is provided an illuminating safety hat, comprising a safety hat, a lamp carriage arm attached at one end to one side of the hat and extending downwardly in spaced relationship to the safety hat wearer's head, and a lamp attached to the other end of the lamp carriage arm so as to be positioned roughly in the area of above and in front of the wearer's collarbone.

DESCRIPTION OF THE DRAWINGS

Other features of the invention will become apparent in the following detailed description of the preferred embodiment. Reference will be made to the accompanying drawings, provided by way of example only, in which.

DESCRIPTION OF THE PREFERRED EMBODIMENT

Figure 1:
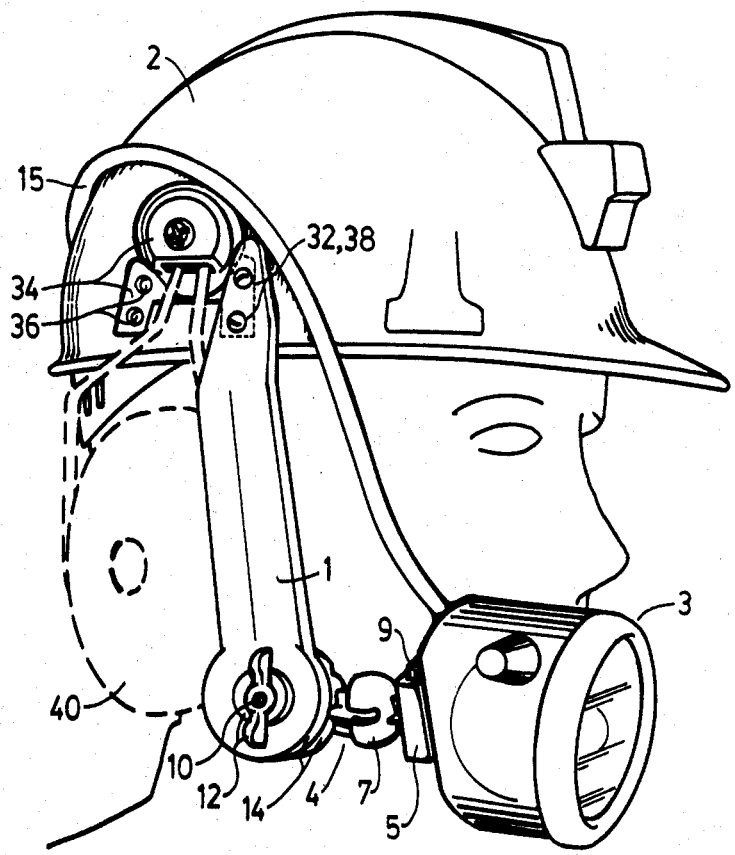
FIG. 1 is an illustration of the preferred embodiment, showing the carriage arm and lamp installed on a safety hat.

Referring now to the drawings, the preferred embodiment of the present invention will be described. A carriage arm 1 is attached to a bracket on the side of a safety hat 2 by two bolts 32. The details of the attachment will be described later. In the preferred embodiment, the carriage arm has a length of approximately 145 millimeters, although obviously there is a fair range of acceptable lengths.

Figure 3:
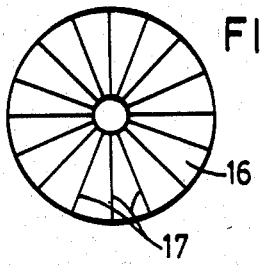
FIG. 3 is a view of lamp position adjustment means for the carriage arm.

A lamp support arm 4, including a ball and socket joint 7, is pivotally connected at one end to the lower end of the carriage arm, and supports a lamp 3 at its other end. A threaded bolt 10 and a wingnut 12 clamp disc portions 14 of the carriage arm and lamp support arm together to lock the lamp support art in position. The opposing faces 16 of the disc portions have serrations 17 to prevent slippage, as seen in FIG. 3. A standard lamp bracket 5 is attached to or integral with the socket portion of the ball joint, and the lamp 3 connects to it via a standard clip 9. A cable 15 is routed to a standard waist-carried battery pack (not illustrated) which powers the light.

Figure 4:
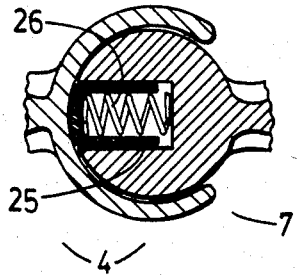
FIG. 4 is a cross-section of a ball and socket joint in the preferred embodiment.

As illustrated in FIG. 4, the ball and socket joint preferably includes a sleeve 25 and a spring 26 within the ball to maintain tension within the joint and thereby prevent slippage. Other means could of course be used to accomplish the same result.

The attachment of the carriage arm to the safety hat will now be described in greater detail. The two bolts 32 shown in FIG. 1 are passed through holes in a bracket 34 manufactured by the Peltor AB of Sweden principally for the carriage of ear protectors. These brackets are commonly used in the mining industry, and are available in Canada from Norhammer Tools Co. Ltd., P.O. Box 2042, Highway 11, Gravenhurst, Ontario POC 1G0. Nuts 33 are threaded onto the bolts 32 and tightened to fasten the carriage arm to the bracket. The bracket in turn is fastened securely to the side of the safety hat.

Figure 2:
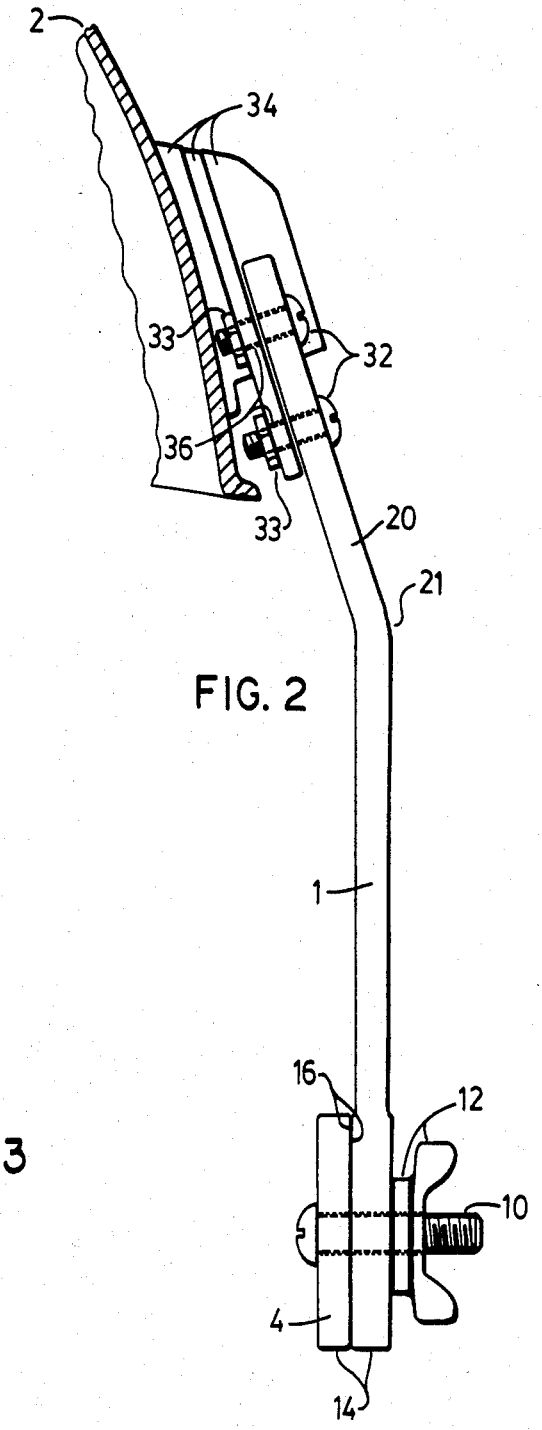
FIG. 2 is a rear view of the carriage arm and safety hat.

If an ear protector is carried from the bracket, in accordance with its usual purpose, it can be accommodated inside and to the rear of the carriage arm, as can be seen from the outline of an ear protector 40 in FIG. 1. As can be seen best from FIG. 2, the upper portion 20 of the carriage arm angles outwardly from the safety hat before bending at an angle of approximately 20 degrees to a more vertical angle at bend 21, thus creating a little more space for the ear protector. The brackets can be purchased as separate items, that is without the necessity of purchasing ear protectors in the event that ear protection is not desired as an additional feature.

As can be seen from FIG. 1, the shape of the upper portion of the carriage arm is such in relation to the shape of the bracket that the carriage arm can be mounted on either of the two pairs of holes, 36 or 38, in the bracket 34. This permits the carriage arm to be carried on either the front or rear pair of holes on brackets on either side of the safety hat, thus offering maximum flexibility. In switching from side to side, if desireable to do so, the wingnut 12 would be loosened and the lamp support arm would be pivoted through 180 degrees.

Figure 5:
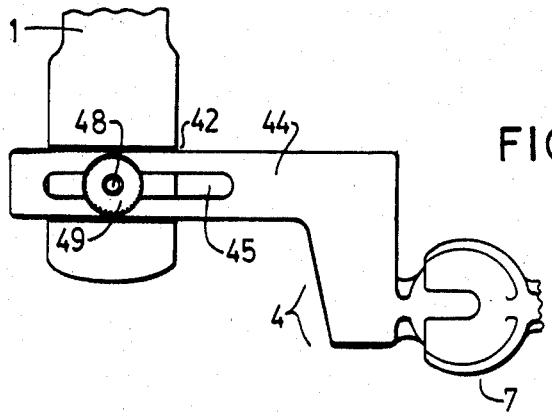
FIG. 5 is an illustration of an alternative embodiment comprising a slotted slider riding in a channel in the carriage arm.
Figure 6:
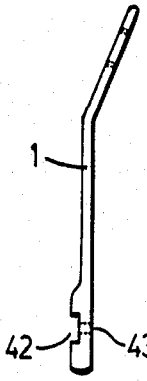
FIG. 6 is a view showing the channel in the carriage arm.

Referring now to FIGS. 5 and 6, an alternative embodiment will be described. In this alternative embodiment, there is a channel 42 near the bottom of the carriage arm 1. The lamp support arm 4 has a slider portion 44 which includes a slot 45. A hole 43 is provided in the channel 42, through the carriage arm, to align with the slot. The slider fits within the channel. A threaded stud 48 passes through the hole and the slot from the inside out, and a knurled thumbnut 49 is provided so that the slider may be secured to the carriage arm. The slot in the slider of course permits the lamp support arm 4 to be moved forward or backward in the channel as desired.

In this alternative embodiment, as in the preferred embodiment, the carriage arm can be carried on either side of the safety hat. The slider 44 is simply removed from the channel 42 by unscrewing the thumbnut 49, and is reinstalled in the channel from the other direction.

The various features of the invention result in several advantages. First, the direction in which the beam of the light is directed can be readily changed by virtue of the ball and socket joint 7. Additionally, in the preferred embodiment, the direction may be changed by virtue of the adjustment of the wingnut 12 to vary the angle of the lamp support arm with respect to the carriage arm, and in the alternative embodiment the lamp may be moved backward and forward. Furthermore, the light may be carried either on the left or the right side of the safety hat. This flexibility of location and direction is obviously advantageous.

The location of the lamp in the general area of in front of the collarbone is particularly advantageous for illuminating close-up work, and for illuminating downwardly for walking or writing or checking dashboards, etc. Task-oriented lighting is greatly improved, and glare is generally reduced because the miner is looking out over most of the light beam rather than through it. The improved lighting and flexibility affords the mine worker greater convenience, effectiveness, and safety.

A minor disadvantage of the present invention is that preferably but not essentially a small counterweight should be installed on the side of the helmet opposite the side on which the lamp carriage arm is installed. It has been found that a 150 gram counterweight is suitable. This slightly increased weight is more than offset by the advantages of the invention in providing improved lighting for convenience and safety.

It will be appreciated that the above description of the preferred and alternative embodiments is by way of example only, and that numerous variations are possible which would still clearly be within the broad scope of the invention as described and claimed.

For example, it should be apparent that any suitable means of attaching the carriage arm to the helmet could be employed. The carriage arm may be bolted directly to the helmet, or may be attached in any suitable manner to any suitable bracket, being in no way limited to attachment to the above-described bracket of Peltor AB.

It should also be apparent that the carriage arm need not have the same shape as the one here described. A wide variety of shapes which would still be within the scope of the invention can be readily envisioned.

Furthermore, although it is highly advantageous to incorporate the ball and socket joint into the design, there are advantages inherent in the position of the lamp which would make it advantageous to use even a carriage arm with no directional adjustment means for the lamp, and such use would be within the scope of the invention. If the adjustment feature is used, it should also be apparent that there are a number of other ways in which this adjustment feature could be obtained, not in any way being limited to a ball and socket type of adjustment. For example, there could be two adjustment mechanisms similar to that described above using the disc portions 14, threaded bolt 10, and wingnut 12. Each would be offset 90 degrees from the other so that one would provide elevation adjustment and the other bearing adjustment.

In the above disclosure, the word "standard" refers to equipment in common use in the mining industry, particularly in Canada. It will be appreciated that such equipment is well known to those skilled in the art, and thus no more detailed description is necessary, particularly since the details of the equipment are not vital to the invention. Thus for example, while those knowledgeable in the mining field are likely to have a clear understanding of the meaning of the words "standard lamp bracket", one not having such an understanding could still clearly carry out the teachings of the present invention, since the lamp bracket is not material to the substance of the invention.

While the invention is here described primarily in the context of a miner's hat for use in the mining industry, it should be apparent that this invention is in no way limited exclusively to the mining field, nor to other underground activity such as spelunking. The invention may be applied wherever there is a need for hands-free portable lighting, where it may be convenient to attach the lighting to a safety hat.

The expression "safety hat" is used in this description for convenience, but this invention is not restricted in its application to safety hats of the type commonly seen on construction sites or in mines. "Safety hat" should be interpreted to include any headgear capable of adequately supporting the carriage arm.

The words "roughly in the area of above and in front of the safety hat wearer's collarbone" are used in this specification, including the claims, to describe the lamp location which results from the use of the present invention. These words should be interpreted liberally, in keeping with the substance and spirit of the invention. Specifically, without limiting the generality of the foregoing, these words should be interpreted to include, to a reasonable limit, areas slightly above the collarbone, above and in front of the collarbone, in front of the collarbone, and below and in front of the collarbone. It will of course be appreciated that areas directly in front of or in front of and below the collarbone may be unsuitable because the safety hat wearer would be unable to turn his or her head without interference.

What I claim as my invention is:

1. A miner's lamp carriage arm comprising:

an arm portion;

first attachment means at one end of said arm portion for attaching said arm portion to a safety hat;

second attachment means remote from said first attachment means for attaching a lamp in which the length of said arm portion is such that said lamp may be attached at said second attachment means for carriage roughly in the area of above and in front of the safety hat wearer's collarbone.

2. A miner's lamp carriage arm as recited in claim 1, in which said second attachment means includes means whereby said lamp may be pivoted with respect to said carriage arm, thereby permitting the direction of the lamp beam to be varied by the safety hat wearer.

3. A miner's lamp carriage arm as recited in claim 2, in which said pivot means includes a ball and a socket in a frictional fit.

4. A miner's lamp carriage arm as recited in claim 1, in which said second attachment means includes a lamp support arm pivotally connected to said miner's lamp carriage arm between said miner's lamp carriage arm and the lamp.

5. A miner's lamp carriage arm as recited in claim 4, in which said lamp support arm comprises two segments pivotally connected to each other by a ball and socket joint.

6. A miner's lamp carriage arm as recited in claim 1, in which said second attachment means includes a lamp support arm comprising a slider engaging a channel provided in said miner's lamp carriage arm, the slider having a slot, the channel having a hole, and the slider being secured in the channel by fastening means passing through the slot and the hole.

7. A miner's lamp carriage arm as recited in claim 6, in which said lamp support arm comprises two segments pivotally connected to each other by a ball and socket joint.

8. A miner's lighting apparatus comprising a lamp carriage arm, attachment means at one end of said lamp carriage arm for attaching said lamp carriage arm to one side of a safety hat, and a lamp attached to the other end of the lamp carriage arm, said lamp carriage arm extending downwardly when attached to the safety hat, in spaced relationship to the safety hat wearer's head, the length of said lamp carriage arm being such that the lamp is positioned roughly in the area of above and in front of the safety hat wearer's collarbone.

9. A miner's lighting apparatus as recited in claim 8, in which said lamp is pivotally attached to the lamp carriage arm, whereby the direction of the lamp's beam may be varied by the safety hat wearer.

10. A miner's lighting apparatus as recited in claim 9, in which said pivotal attachment includes a ball and a socket in a frictional fit.

11. A miner's lighting apparatus as recited in claim 8, in which said lamp is pivotally attached to the end of the carriage arm, the pivotal attachment including a lamp support arm pivotally connected to said lamp carriage arm between said lamp carriage arm and the lamp.

12. A miner's lighting apparatus as recited in claim 11, in which said lamp support arm comprises two segments pivotally connected to each other by a ball and socket joint.

13. A miner's lighting apparatus as recited in claim 8, in which said lamp is pivotally attached to the end of the carriage arm, the pivotal attachment including a lamp support arm comprising a slider engaging a channel provided in said lamp carriage arm, the slider having a slot, the channel having a hole, and the slider being secured in the channel by fastening means passing through the slot and the hole.

14. A miner's lighting apparatus as recited in claim 13, in which said lamp support arm comprises two segments pivotally connected to each other by a ball and socket joint.

15. A miner's safety hat, comprising a safety hat, a lamp carriage arm attached at one end to one side of said safety hat and extending downwardly in spaced relationship to the safety hat wearer's head, and a lamp attached to the other end of the lamp carriage arm, the length of said lamp carriage arm being such that the lamp is positioned roughly in the area of above and in front of the safety hat wearer's collarbone.

16. A miner's safety hat as recited in claim 15, in which said lamp is pivotally attached to the carriage arm, whereby the direction of the beam of the lamp may be varied by the hat wearer.

17. A miner's safety hat as recited in claim 16, in which said pivotal attachment includes a ball and a socket in a frictional fit.

18. A miner's safety hat as recited in claim 15, in which said lamp is pivotally attached to said carriage arm, the pivotal connection including a lamp support arm pivotally connected to said lamp carriage arm between said lamp carriage arm and the lamp.

19. A miner's safety hat as recited in claim 18, in which said lamp support arm comprises two segments pivotally connected to each other by a ball and socket joint.

20. A miner's safety hat as recited in claim 15, in which said lamp is pivotally attached to the end of the carriage arm, the pivotal attachment including a lamp support arm comprising a slider engaging a channel provided in said lamp carriage arm, the slider having a slot, the channel having a hole, and the slider being secured in the channel by fastening means passing through the slot and the hole.

21. A miner's safety hat as recited in claim 20, in which said lamp support arm comprises two segments pivotally connected to each other by a ball and socket joint.

* * * * *